US006547376B1

(12) United States Patent
Watanabe et al.

(10) Patent No.: US 6,547,376 B1
(45) Date of Patent: Apr. 15, 2003

(54) INK JET HEAD AND METHOD FOR THE MANUFACTURE THEREOF

(75) Inventors: Osamu Watanabe, Kumamoto (JP); Koji Matsuo, Fukuoka (JP); Kenji Tomita, Kumamoto (JP); Isaku Kanno, Nara (JP); Eiichiro Tanaka, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/553,160

(22) Filed: Apr. 19, 2000

(30) Foreign Application Priority Data

Apr. 21, 1999 (JP) ..... 11-113249

(51) Int. Cl.[7] ..... B41J 2/045
(52) U.S. Cl. ..... 347/70; 347/71
(58) Field of Search ..... 347/68–72

(56) References Cited

U.S. PATENT DOCUMENTS 6,010,209 A * 1/2000 Kitahara ..... 347/71
6,206,499 B1 * 3/2001 Lijima et al. ..... 347/33
6,347,862 B1 * 2/2002 Kanno et al. ..... 347/68

FOREIGN PATENT DOCUMENTS

| | | | |
|---|---|---|---|
| JP | 03015555 | * | 1/1991 |
| JP | 06218927 | A | 8/1994 |
| JP | 07195689 | A | 8/1995 |
| JP | 07276627 | A | 10/1995 |
| JP | 10278263 | A | 10/1998 |

* cited by examiner

*Primary Examiner*—Judy Nguyen
*Assistant Examiner*—Ly T Tran
(74) *Attorney, Agent, or Firm*—Harness, Dickey & Pierce, PLC

(57) ABSTRACT

Formed on a surface of an oscillation plate on the side of a head main body portion is an intermediate layer having a window portion through which a displacement portion of the oscillation plate is exposed to a pressure chamber. The intermediate layer and a compartmenting wall of the main body portion are adhered together by an adhesive of electro-deposition resin. The intermediate layer is formed of copper, having a thickness of 5 $\mu$m, so that, when a part of the adhesive is forced out, such a forced-out adhesive portion will not adhere to the displacement portion of the oscillation plate.

13 Claims, 15 Drawing Sheets

$$\text{ADHESIVE AREA}(\%) = \frac{\text{ADHESIVE WIDTH W1}(\mu\text{m})}{\text{PARTITIONING PORTION WIDTH W}(\mu\text{m})} \times 100$$

$$\text{OFFSET AMOUNT}(\%) = \frac{\text{OFFSET AMOUNT OS}(\mu\text{m})}{\text{PARTITIONING PORTION WIDTH W}(\mu\text{m})} \times 100$$

INK JET HEAD AND METHOD FOR THE MANUFACTURE THEREOF

FIELD OF THE INVENTION

The present invention relates to an ink jet head, and to a method for the manufacture thereof.

BACKGROUND OF THE INVENTION

Ink jet recording devices making utilization of the piezoelectric effect of piezoelectric elements to effect printing have been used as a printer, a word processing machine, a facsimile machine, etc. Some ink jet recording devices employ an ink jet head having a multi-level layered construction of thin films, like the one shown in FIGS. 14 and 15.

Referring to the ink jet head-of the figures, formed in the interior of a main body portion 108 of the head are a plurality of pressure chambers 101 which are arranged along a direction L2, and a common ink chamber 102 which has a long and narrow shape in the direction L2. Each of the plurality of pressure chambers 101 is formed into a strip-like shape having a horizontal cross section which has a long and narrow shape in a direction L1. The pressure chambers 101 are in communication through their respective ink supply passages 105 with the common ink chamber 102. Nozzle orifices 103 are formed in a front side of the ink jet head (the lower one of the sides of the ink jet head in FIG. 14). The nozzle orifice 103 is in communication through an ink discharging passage 104 with the pressure chamber 101. Each pressure chamber 101 is compartmented with an oscillation plate 112 at its back side (the upper one of the sides in FIG. 14). The oscillation plate 112 is formed of Cr (chromium) and functions as a common electrode for applying a voltage to piezoelectric elements 106. The piezoelectric element 106 is jointed to a back side of the oscillation plate 112. Mounted on a back side of the piezoelectric element 106 is an individual electrode 111. The individual electrode 111, the piezoelectric element 106 and the oscillation plate 112 together form an actuator portion 107 for applying a pressure to the ink in the pressure chamber 101. The main body portion 108 and the oscillation plate 112 are bonded together by an adhesive 120.

With the recent advancement of the resolution of recording devices to a higher degree, the miniaturization of head structures has been improved. Correspondingly, the gap between two piezoelectric elements 106 next to each other becomes shorter as shown in FIG. 15 and the thickness of a compartmenting wall 109 which compartments the pressure chamber 101 becomes thinner. Accordingly, when adhering together the main body portion 108 and the oscillation plate 112, there are some cases in which the adhesive 120 is forced out of the butt surface, as indicated by the virtual line (the two-dot chain line) of FIG. 15 and a part 114 of the forced-out adhesive adheres to a displacement portion 113 of the oscillation plate 112. This causes the displacement portion 113 of the oscillation plate 112 to decrease in its displacement amount, in addition to which the displacement portion 113 is stopped from performing a smooth displacement operation, therefore resulting in a drop in the ink discharging performance. Further, it is possible that the displacement amount of the oscillation plate 112 varies from one pressure chamber to another, resulting in poor print quality.

Bearing in mind the above-described problems with the prior art techniques, the invention was made. Accordingly, an object of the present invention is to provide such adhesion between a head main body and an oscillation plate that the adhesive will not become an obstacle to the displacement operation of the oscillation plate.

SUMMARY OF THE INVENTION

In order to achieve the object, the present invention provides an ink jet head. More specifically, the ink jet head of the present invention comprises (a) a head main body portion in which a pressure-chamber recess portion and a nozzle orifice are formed and (b) an actuator portion having (i) an oscillation plate which covers the pressure-chamber recess portion of the head main body portion so as to form, together with the head main body portion, a pressure chamber in the form of a compartment and (ii) a piezoelectric element which is rigidly fixed to the oscillation plate whereby the displacement of the oscillation plate generated by the piezoelectric effect of the piezoelectric element forces ink in the pressure chamber out of the nozzle orifice, wherein an intermediate layer is formed between the oscillation plate and the head main body portion for the prevention of adhesive adhesion to the oscillation plate and wherein the oscillation plate and the head main body portion are rigidly fixed together by an adhesive through the intermediate layer.

As a result of such arrangement, even when a part of the adhesive is forced out in adhering together the head main body and the oscillation plate, the provision of the intermediate layer between the adhesive and the oscillation plate causes the forced-out adhesive to adhere to the intermediate layer. Accordingly, the forced-out adhesive is prevented from adhering to the displacement portion of the oscillation plate, therefore ensuring that the oscillation plate satisfactorily performs its displacement operation. As a result, the variation in displacement is prevented, thereby achieving a stable ink discharging performance.

The present invention provides another ink jet head which comprises (a) a head main body portion in which a pressure-chamber recess portion and a nozzle orifice are formed and (b) an actuator portion having (i) an oscillation plate which covers the pressure-chamber recess portion of the head main body portion so as to form, together with the head main body portion, a pressure chamber in the form of a compartment and (ii) a piezoelectric element which is rigidly fixed to the oscillation plate whereby the displacement of the oscillation plate generated by the piezoelectric effect of the piezoelectric element forces ink in the pressure chamber out of the nozzle orifice, wherein an intermediate layer having a window portion through which a displacement portion of the oscillation plate is exposed to the pressure chamber, and consisting of metal, ceramics, or resin is formed on a surface of the oscillation plate on the side of the head main body, and wherein the oscillation plate and the head main body portion are rigidly fixed together by an adhesive through the intermediate layer.

Accordingly, by the use of thin film formation technology including sputtering and CVD, the intermediate layer used for the prevention of adhesive adhesion to the displacement portion of the oscillation plate can be formed easily.

The use of copper facilitates the formation of relatively thick films, and therefore the intermediate layer is preferably formed of copper. As a result of such arrangement, it is possible to easily form the intermediate layer having a thicker film thickness capable of the prevention of adhesive adhesion to the oscillation plate without fail. Moreover, the copper is superior in workability, that is, it is easily etched. Therefore, the window portion can be formed easily.

The intermediate layer may be formed of titanium. This extends the life span of the intermediate layer because the titanium is not readily degraded even when exposed to the ink. Moreover, the degree of adhesion between titanium and chromium is high, so that, when chromium is used for the oscillation plate, the adhesion with respect to the oscillation plate is enhanced. Accordingly, there is no need for the provision of an adhesion improving layer used to improve the degree of adhesion between the intermediate layer and the oscillation plate, whereby the manufacture process can be shortened.

If the intermediate layer is formed too thin, then the adhesive is likely to adhere to the displacement portion of the oscillation plate. Taking into account this point, it is preferred that the intermediate layer is formed, having a thickness of 5 $\mu$m or greater. As a result of such arrangement, it becomes possible to effectively prevent the adhesive from adhering to the displacement portion of the oscillation plate.

Furthermore, it is more preferable that the intermediate layer is formed, having a thickness of more than 7 $\mu$m. This further ensures that the adhesive is prevented from adhering to the displacement portion of the oscillation plate.

On the other hand, if the intermediate layer is formed too thick, this makes it difficult to form the intermediate film having a well arranged shape. It is therefore preferable that the intermediate layer is formed, having a thickness of 30 $\mu$m or less. This facilitates the formation of intermediate layers having an adequate shape.

The degree of adhesion between the intermediate layer and the oscillation plate become insufficient in some cases because of the material used. Therefore, an arrangement may be made in which an adhesion improving layer is sandwiched between the intermediate layer and the oscillation plate for the enhancement of the degree of adhesion between them. By virtue of the placement of the adhesion improving layer between the intermediate layer and the oscillation plate, the degree of adhesion between them can be enhanced, as a result of which the peeling-off of the intermediate layer can be prevented.

It is arranged such that the oscillation plate is formed of chromium, the intermediate layer is formed of copper, and the adhesion improving layer is formed of titanium. Because of such arrangement, even though the oscillation plate is formed of chromium and the intermediate layer is formed of copper, it is possible to tightly adhere the intermediate layer and the oscillation plate together because the degree of adhesion of titanium with respect to chromium is high.

In order to prevent the adhesion improving layer from being formed into an island-like shape so that the adhesion improving layer becomes a satisfactory layer, it is preferred that the adhesion improving layer is formed, having a thickness of 0.01 $\mu$m or greater. As a result of such arrangement, the adhesion improving layer functions to tightly adhere the oscillation plate and the intermediate plate together.

The present invention provides still another ink jet head which comprises (a) a head main body portion in which a pressure-chamber recess portion and a nozzle orifice are formed and (b) an actuator portion having (i) an oscillation plate which covers the pressure-chamber recess portion of the head main body portion so as to form, together with the head main body portion, a pressure chamber in the form of a compartment and (ii) a piezoelectric element which is rigidly fixed to the oscillation plate whereby the displacement of the oscillation plate generated by the piezoelectric effect of the piezoelectric element forces ink in the pressure chamber out of the nozzle orifice, wherein a projection portion for mounting the oscillation plate on the head main body portion is formed on a surface of the oscillation plate opposite to the head main body portion.

An arrangement may be made, in which the oscillation plate and the head main body portion are rigidly fixed together by an adhesive through the projection portion.

Accordingly, the projection portion which is a part of the oscillation plate functions as the foregoing intermediate layer. As a result of such arrangement, the intermediate layer is no longer to be formed separately from the oscillation plate. Moreover, there is no need to attach the intermediate layer to the oscillation plate.

The present invention provides a method of manufacturing an ink jet head in which an oscillation plate is displaced by the piezoelectric effect of a piezoelectric element and the displacement of the oscillation plate forces ink in a pressure chamber out of a nozzle orifice, the method comprising the steps of (a) forming on a surface of the oscillation plate an intermediate layer, (b) forming an opening in a position of said intermediate layer corresponding to a displacement portion of the oscillation plate, and (c) with the opening of said intermediate layer brought into agreement in position with a pressure-chamber recess portion of the head main body portion, adhering together the intermediate layer and the head main body portion.

As a result of such arrangement, the oscillation plate and the head main body portion are rigidly adhered together by adhesive through the intermediate layer. Accordingly, even when a part of the adhesive is forced out in adhering the oscillation plate and the head main body portion together, the forced-out adhesive will adhere to the intermediate layer, whereby adhesive adhesion to the displacement portion of the oscillation plate is prevented.

The present invention provides another method of manufacturing an ink jet head in which an oscillation plate is displaced by the piezoelectric effect of a piezoelectric element and the displacement of the oscillation plate forces ink in a pressure chamber out of a nozzle orifice, the method comprising the steps of (a) forming on a surface of the oscillation plate an adhesion improving layer, (b) forming on a surface of the adhesion improving layer an intermediate layer, (c) forming an opening in at least a position of the intermediate layer corresponding to a displacement portion of the oscillation plate, and (d) with the opening of the intermediate layer brought into agreement in position with a pressure-chamber recess portion of the head main body portion, adhering together the intermediate layer and the head main body portion.

As a result of such arrangement, the adhesion improving layer is formed between the oscillation plate and the intermediate layer, wherein the intermediate layer is rigidly secured to the oscillation plate through the adhesion improving layer. Thus, the oscillation plate and the head main body portion are tightly secured together by an adhesive through the intermediate layer. Accordingly, even when a part of the adhesive is forced out in adhering the oscillation plate and the head main body portion together, the forced-out adhesive will adhere to the intermediate layer, whereby adhesive adhesion to the displacement portion of the oscillation plate is prevented.

As described above, in accordance with the present invention, the intermediate layer is formed between the oscillation plate and the head main body portion, so that the adhesive is prevented from adhering to the displacement portion of the oscillation plate in adhering the actuator portion and the head main body portion together. This accordingly enables the oscillation plate to perform a displacement operation in a smooth manner, thereby achieving an improved ink discharging performance.

The intermediate layer is formed of copper, thereby facilitating the formation of a relatively thick film well-arranged in shape. This therefore makes it possible to form, in an easy manner, a layer suitably used for the prevention of adhesive adhesion to the oscillation plate. Moreover, it is possible to easily form the window portion for the displacement portion of the oscillation plate.

The arrangement that the intermediate layer is formed of titanium makes it possible to make the intermediate layer less readily degraded when exposed to ink. Moreover, if the oscillation plate is formed of chromium, this makes it possible to enhance the degree of adhesion between the intermediate layer and the oscillation plate.

By virtue of the provision of the adhesion improving layer between the intermediate layer and the oscillation plate, the degree of adhesion between the intermediate layer and the oscillation plate can be enhanced, therefore preventing the peeling-off of the intermediate layer without fail.

DESCRIPTION OF THE PREFERRED EMBODIMENTS

Embodiments of the present invention will be described below by reference to the accompanying drawing figures.

Embodiment 1

Ink Jet Head Structure

Figure 1:
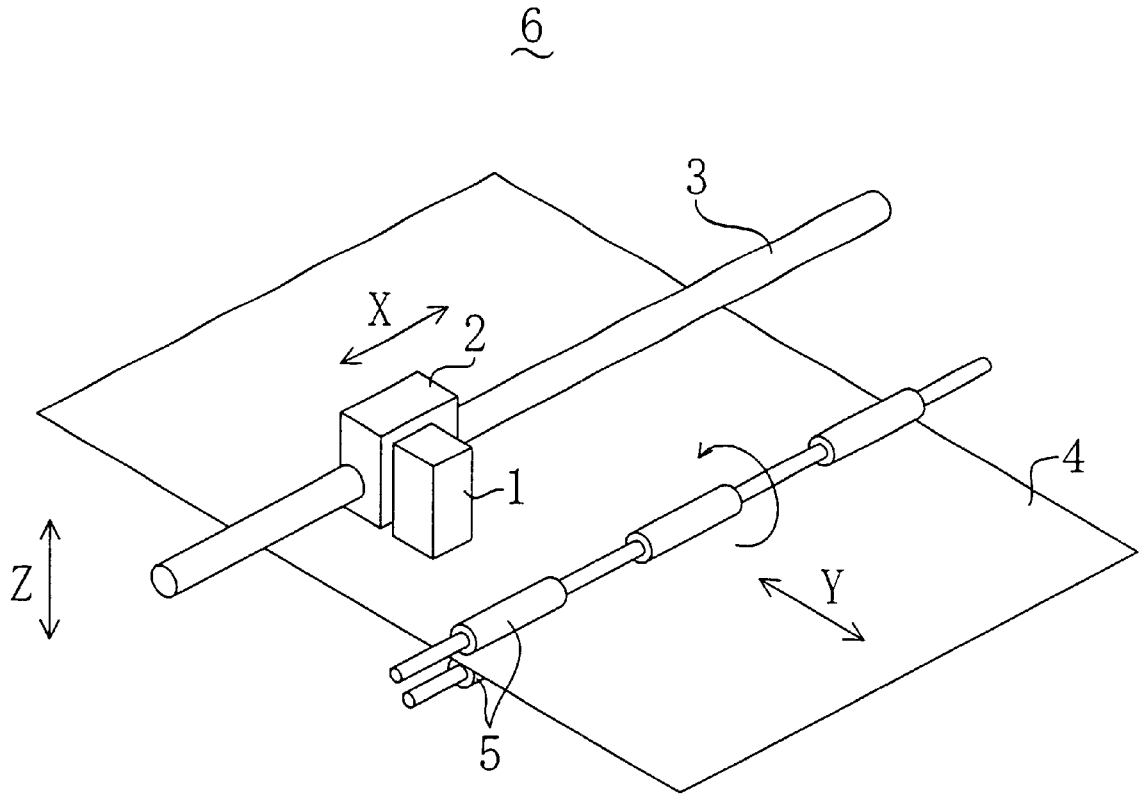
FIG. 1 is a schematic structure diagram of an ink jet printer.

As FIG. 1 shows, an ink jet head 1 according to a first embodiment of the present invention is incorporated in an ink jet printer 6, wherein droplets of ink ejected from the ink jet head 1 are landed on a recording medium such as a sheet of paper to effect printing. The ink jet head 1 is mounted on a carriage 2 which moves alternately backward and forward along a carriage shaft 3. Accordingly, the ink jet head 1 reciprocates together with the carriage 2 in a primary scanning direction X. Rollers 5 are provided to convey the recording medium 4 in a secondary scanning direction Y every time the carriage 2 travels a distance of one scan in the primary scanning direction X.

Figure 2:
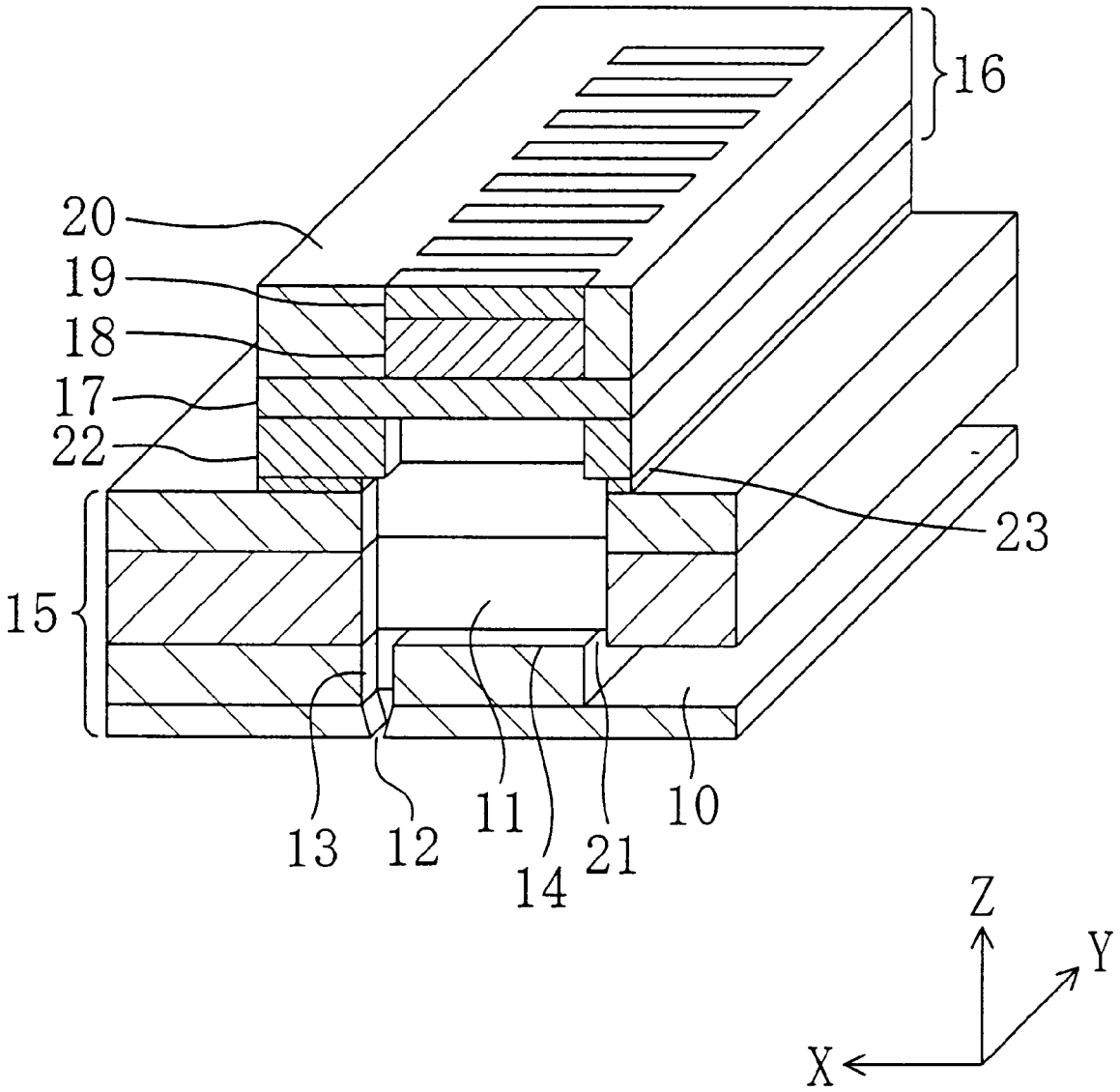
FIG. 2 is a perspective view of an ink jet head according to a first embodiment of the present invention.

Referring to FIG. 2, the ink jet head 1 comprises a main body portion 15 and an actuator portion 16. Formed in the main body portion 15 are a common ink chamber 10, a plurality of recess portions 14 for their respective pressure chambers, and a plurality of nozzle orifices 12. The actuator portion 16 applies a pressure to the ink in the pressure chamber 11.

The pressure-chamber recess portions 14 of the main body portion 15 are arranged at predefined intervals along the secondary scanning direction Y. The pressure-chamber recess portions 14 has an opening with a cross section (an X-Y cross section) formed into an approximately rectangular shape which is long and narrow in the primary scanning direction X. Formed at one longitudinal end of the bottom of the pressure-chamber recess portion 14 (the right-hand side end in FIG. 2) is an ink supply opening 21 for establishing communication between the common ink chamber 10 and the pressure chamber 11. On the other hand, formed at the other end of the pressure-chamber recess portion 14 (the left-hand side end in FIG. 2) is an ink flow passage 13 for establishing communication between the pressure chamber 11 and the nozzle orifice 12.

The actuator portion 16 has a chromium (Cr) oscillation plate 17 having a thickness of 2 $\mu$m, a piezoelectric element 18 which is a thin PZT film having a thickness of 3 $\mu$m and formed on the oscillation plate 17, a platinum (Pt) individual electrode 19 having a thickness of 0.1 $\mu$m and formed on the piezoelectric element 18, and an insulating layer 20 which is a polyimide thin film with which a gap, which is defined between a lamination of the piezoelectric element 18 and the individual electrode 19 and its adjoining lamination of the piezoelectric element 18 and the individual electrode 19, is filled. The oscillation plate 17 is fixed rigidly to a back side of the main body portion 15 (the upper one of the sides in FIG. 2) through an intermediate layer 22 which is described later, so as to cover all of the pressure-chamber recess portions 14 of the main body portion 15.

Figure 3:
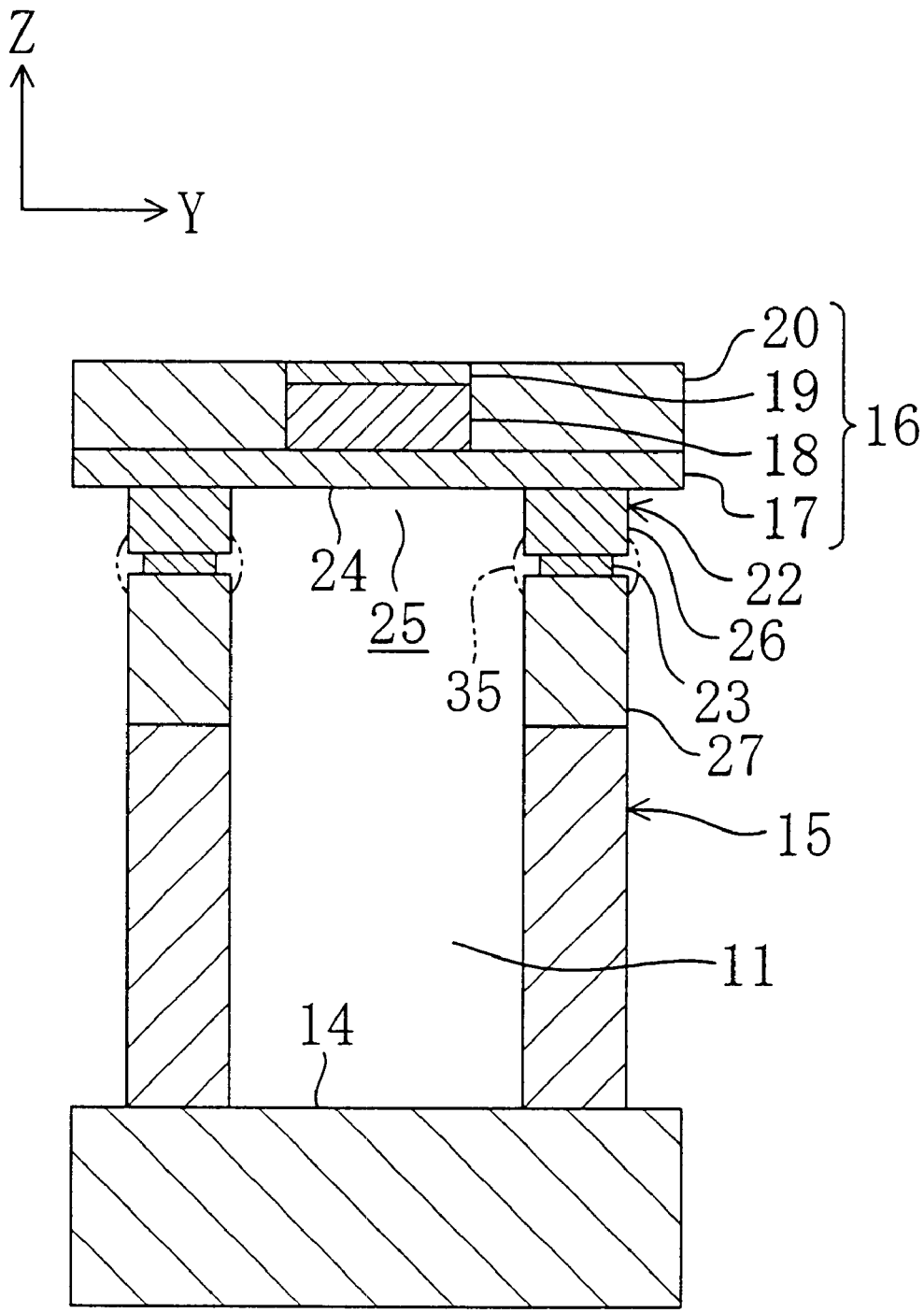
FIG. 3 is a partially sectional view of the ink jet head according to the first embodiment.

As shown in FIG. 3, the piezoelectric element 18 and the individual electrodes 19 are formed at respective positions corresponding to the pressure-chamber recess portion 14. It is arranged such that each of the piezoelectric element 18 and the individual electrode 19 has a horizontal cross-sectional area slightly smaller than the pressure-chamber recess portion 14. The insulating layer 20 is provided in order to prevent the occurrence of shorting between the adjoining individual electrodes 19.

The actuator portion 16 and the main body portion 15 are rigidly fixed together through an adhesive 23. The intermediate layer 22 of copper (Cu) is formed on a front side of the oscillation plate 17 (the lower one of the sides in FIG. 3) in such a manner as to provide a predefined space between the oscillation plate 17 and the adhesive 23 thereby to prevent the adhesive 23 from adhering to a displacement portion 24 of the oscillation plate 17. In order not to obstruct the displacement operation of the oscillation plate 17 in discharging ink droplets, a window portion 25 is formed in a position of the intermediate layer 22 corresponding to the displacement portion 24 of each oscillation plate 17. The window portion 25 is for exposing the displacement portion 24 of the oscillation plate 17 to the pressure chamber 11 and comprises an opening having an area slightly larger than the piezoelectric element 18.

The adhesive 23, which is formed of an electro deposition resin, is applied between the front side of the intermediate layer 22 and the back side of the main body portion 15. In other words, the adhesive 23 adheres together the intermediate layer 22 and the main body portion 15, whereby the actuator portion 16 and the main body portion 15 are rigidly fixed together.

The width of a partitioning portion 26 which separates the adjoining window portions 2 in the intermediate layer 22 (the lateral length in FIG. 3) is equal to that of a compartmenting wall 27 of the main body portion 15 which compartments the pressure chamber 11. However, the width of the partitioning portion 26 of the intermediate layer 22 may have any value as long as the displacement operation of the displacement portion 24 of the oscillation plate 17 is not obstructed. For instance, the width of the partitioning portion 26 may be set wider than that of the compartmenting all 27 of the main body portion 15. Conversely, the width of the partitioning portion 26 may be set smaller than that of the partitioning wall 27.

Thickness of the Intermediate Layer 22

Viewed in the fact that the shape of the window portion 25 is arranged by, for example, etching, the intermediate layer 22 should be thin, the thinner the better. On the other hand, in view of stabilizing the displacement of the oscillation plate 17 by preventing the adhesive 23 from adhering to the oscillation plate 17, the intermediate layer 22 should be thick, the thicker the better. Accordingly, it is required that the thickness of the intermediate layer 22 be determined by comparing and considering these two contradicting views.

Figure 4A:
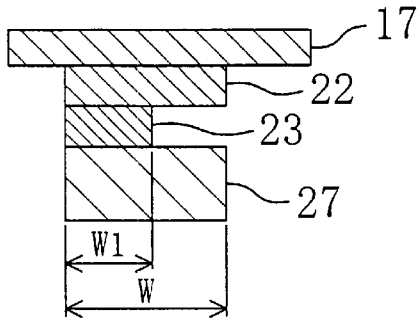
FIGS. 4(*a*) and 4(*b*) are diagrams showing the deviation amount of displacement of the oscillation plate with respect to the adhesive area, FIG. 4(*a*) showing an analytical model, FIG. 4(*b*) showing a result of the analysis.
Figure 4B:
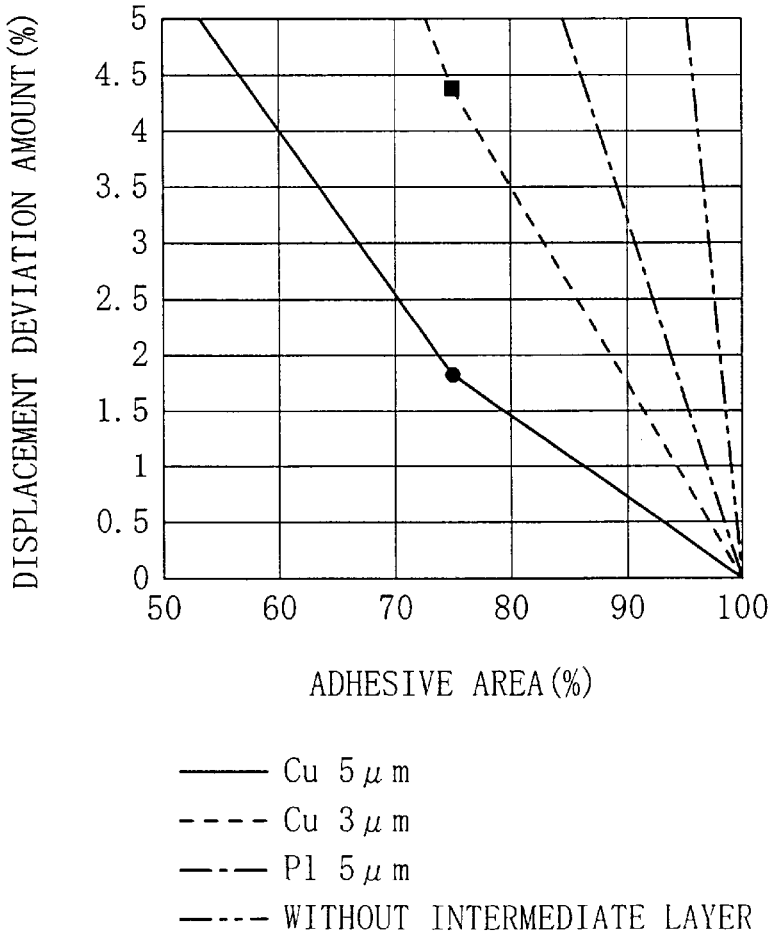

FIG. 4(*b*) is a graph showing a result of the analysis carried out using a structure analytical model of FIG. 4(*a*). FIG. 4(*b*) shows the amount of deviation of the displacement of the oscillation plate 17 with respect to the reduction in the adhesive area of the adhesive 23. In the graph of FIG. 4(*b*), the abscissa indicates the adhesive-area ratio and the ordinate indicates the displacement deviation amount with respect to the displacement when the adhesive area is 100% (i.e., the ideal displacement). Here, a first example case in which a Cu film having a thickness of 5 $\mu$m (indicated by the solid line in the figure) is formed as the intermediate layer 22, a second example case in which a Cu film having a thickness of 3 $\mu$m (indicated by the broken line) is formed as the layer 22, and a third example case in which a P1 (polyimide) film having a thickness of 5 $\mu$m (indicated by the one-dot chain line) is formed as the layer 22, and a fourth example in which the intermediate layer 22 is not provided (indicated by the two-dot chain line) are shown. The Young's modulus of copper is assumed to be $1.22\times10^{11}$[N/m$^2$] and that of polyimide is assumed to be $8.0\times10^{9}$[N/m$^2$]. The result shows that, when the intermediate layer 22 is formed of a Cu layer having a thickness of 5 $\mu$m or greater, the displacement deviation amount can be held within ±2% by securing the adhesive area at 75% or greater.

Figure 5A:
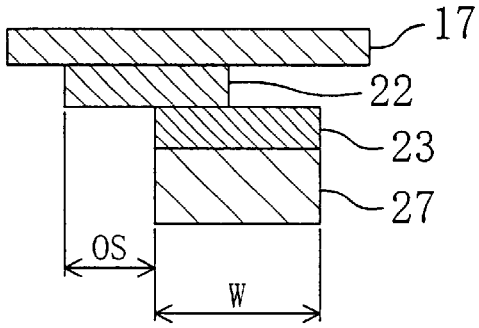
FIGS. 5(*a*) and 5(*b*) are diagrams showing the deviation amount of displacement of the oscillation plate with respect to the offset amount of the intermediate layer, FIG. 5(*a*) showing an analytical model, FIG. 5(*b*) showing a result of the analysis.
Figure 5B:
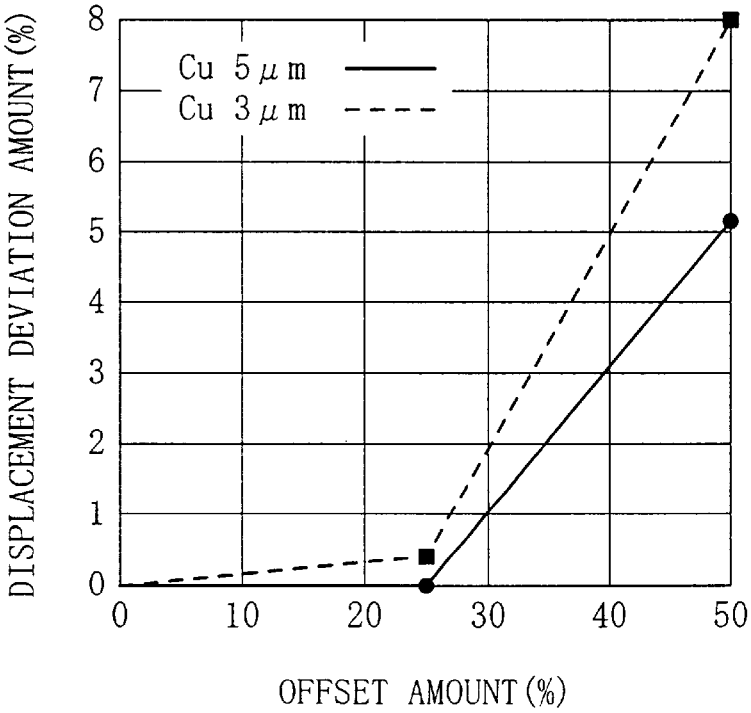
Figure 6A:
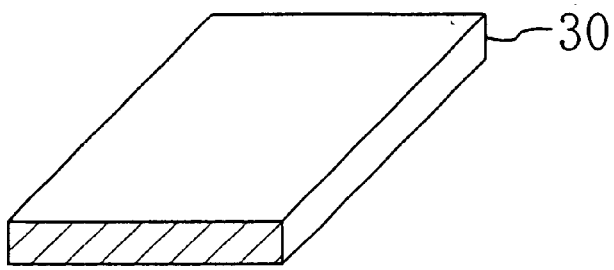
FIGS. 6(*a*)–6(*d*) are diagrams showing a part of steps of a fabrication method of the ink jet head according to the first embodiment.
Figure 6B:
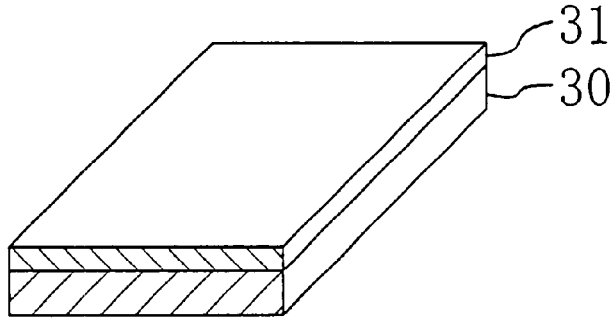
Figure 6C:
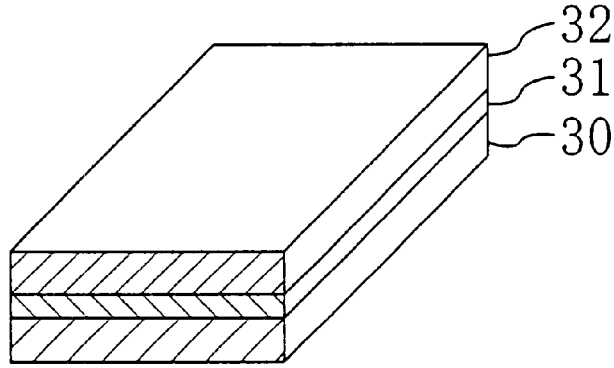
Figure 6D:
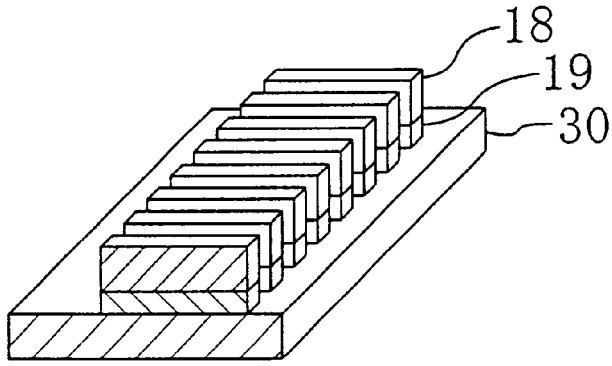
Figure 7A:
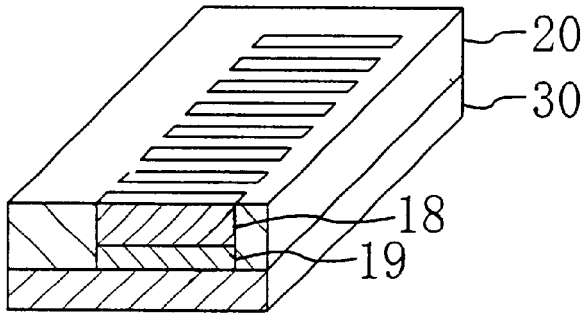
FIGS. 7(*a*)–7(*d*) are diagrams showing a part of the fabrication method steps of the ink jet head according to the first embodiment.
Figure 7B:
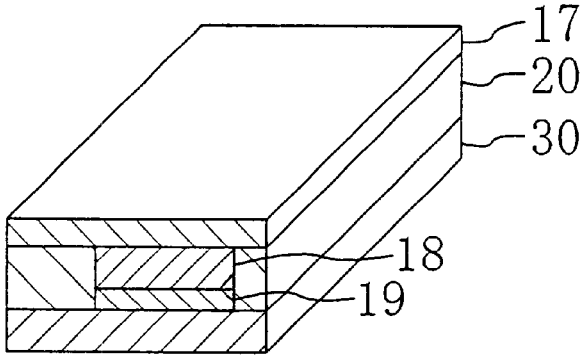
Figure 7C:
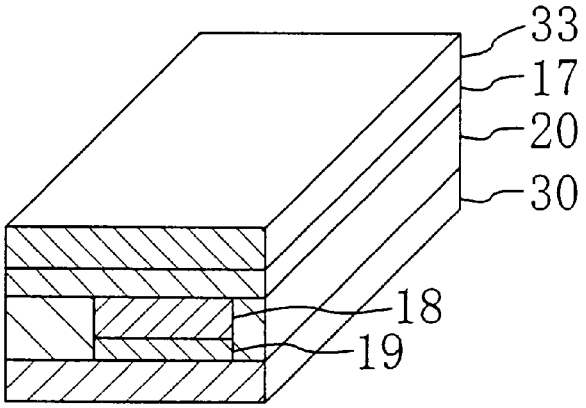
Figure 7D:
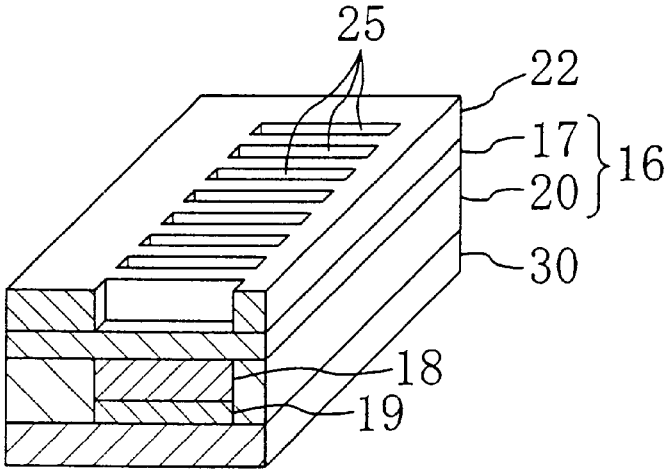

FIG. 5(*b*) is a graph showing the amount of deviation of the displacement of the oscillation plate 17 with respect to the offset amount of the intermediate layer 22. Here, a structure analytical model of FIG. 5(*a*) was used to analyze both a Cu film having a thickness of 5 $\mu$m (indicated by the solid line) and a Cu film having a thickness of 3 $\mu$m (indicated by the broken line). The result shows that, for the case of a Cu film having a thickness of 5 $\mu$m or greater, the displacement deviation amount can be held within ±2% if the offset amount falls within 35%.

Accordingly, in the present embodiment, the thickness of the intermediate layer 22 is set at 5 $\mu$m according to the analysis results. However, if the constraint on the displacement deviation amount is not that serious, the thickness of the intermediate layer 22 may fall below 5 $\mu$m. Conversely, if the constraint on the displacement deviation amount is much severer, the thickness of the intermediate layer 22 should be thicker, for example, preferably above 7 $\mu$m. If the intermediate layer 22 is formed too thick, this makes it difficult to form a shape-arranged uniform layer. It is therefore preferable for the intermediate layer 22 to have a thickness of 30 $\mu$m or less, especially preferably, 15 $\mu$m or less.

Method of Manfacturing Ink Jet Head

Referring now to FIGS. 6–9, a way of manufacturing the ink jet head 1 of the present embodiment will be described below.

First, a substrate 30 of magnesium oxide (MgO) is prepared (see FIG. 6(*a*)). This is followed by application of a Pt film 31 having a thickness of 0.1 $\mu$m on the surface of the substrate 30 (see FIG. 6(*b*)). Subsequently, a c-axis orientation, 3-$\mu$m thick PZT thin film 32 is formed on the surface of the Pt film 31 (see FIG. 6(*c*)).

Thereafter, as shown in FIG. 6(*d*), the Pt film 31 and the PZT film 32 are subjected to divisional patterning in order that the patterned films 31 and 32 remain at corresponding positions to the respective pressure chambers. The individual electrode 19 and the piezoelectric element 18 are formed from these Pt and PZT films 31 and 32.

Next, as FIG. 7(*a*) shows, the polyimide 20 is embedded in portions where the films 31 and 32 were removed by the foregoing patterning thereby to prevent the occurrence of shorting between the adjoining individual electrodes 19 and the surface thereof is subjected to planarization. Thereafter, as shown in FIG. 7(*b*), a Cr film having a thickness of 2 $\mu$m serving as the oscillation plate 17 is formed overlying the piezoelectric elements 18 and the polyimide 20 which have been planarized.

Following the above, as shown in FIG. 7(*c*), a Cu film 33 having a thickness of 5 $\mu$m is formed atop the oscillation plate 17. Thereafter, the Cu film 33 is patterned by etching so as to form an opening at a corresponding position to the displacement portion 24 of each oscillation plate 17. As a result, the intermediate layer 22 with the window portions 25 opened therein is formed (see FIG. 7(*d*)). In the way descried above, the intermediate layer 22 and the actuator portion 16 are obtained.

Next, the actuator portion 16 is secured tightly to a photosensitive glass substrate 34 in which openings for each of the pressure chambers 11 have been preformed. This glass substrate 34 forms a part of the main body portion 15. More concretely, as FIG. 8(*a*) shows, after the adhesive 23 of electro-deposition resin is applied either to the intermediate layer 22 or to the glass substrate 34, the intermediate layer 22 and the glass substrate 34 are brought into close contact with each other, whereby the intermediate layer 22 and the glass substrate 34 are rigidly secured together by the adhesive 23 (see FIG. 8(*b*)). The displacement portion 24 of the oscillation plate 17 is considerably spaced away from the adhesive 23 by the intermediate layer 22, so that, even when a part of the adhesive 23 is forced out as indicated by the virtual line of FIG. 3, a forced-out adhesive 35 will not reach the displacement portion 24 of the oscillation plate 17. Accordingly, the displacement operation of the displacement portion 24 of the oscillation plate 17 will not be obstructed when the actuator portion 16 operates.

Figure 8A:
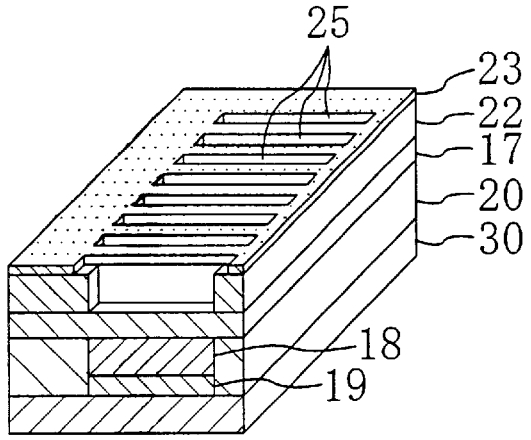
FIGS. 8(*a*)–8(*c*) are diagrams showing a part of the fabrication method steps of the ink jet head according to the first embodiment.
Figure 8B:
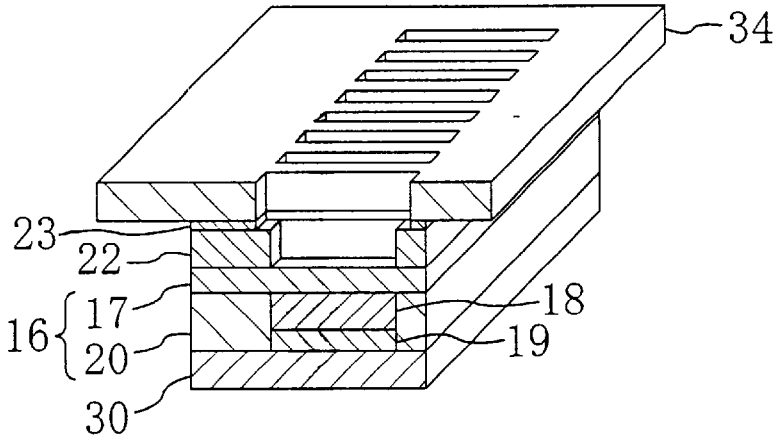
Figure 8C:
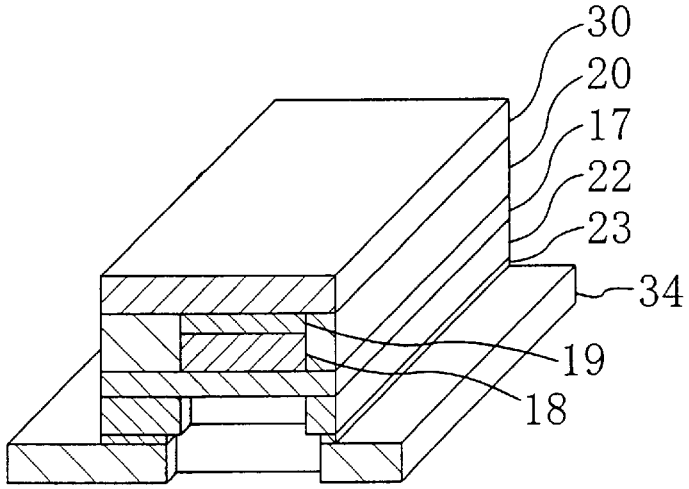
Figure 9A:
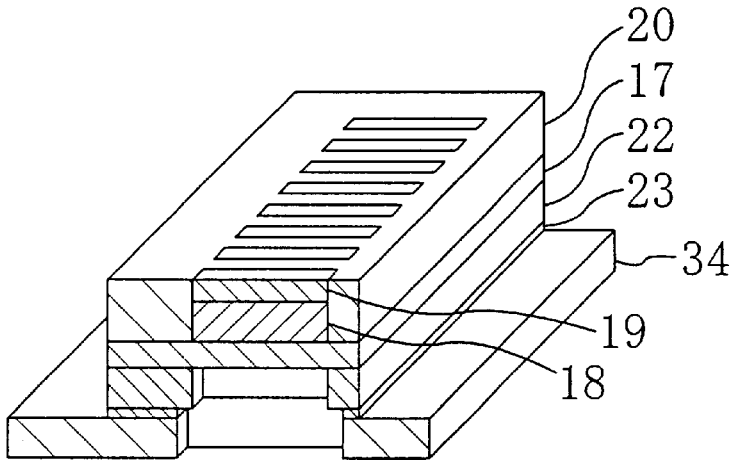
FIGS. 9(*a*) and 9(*b*) are diagrams showing a part of the fabrication method steps of the ink jet head according to the first embodiment.
Figure 9B:
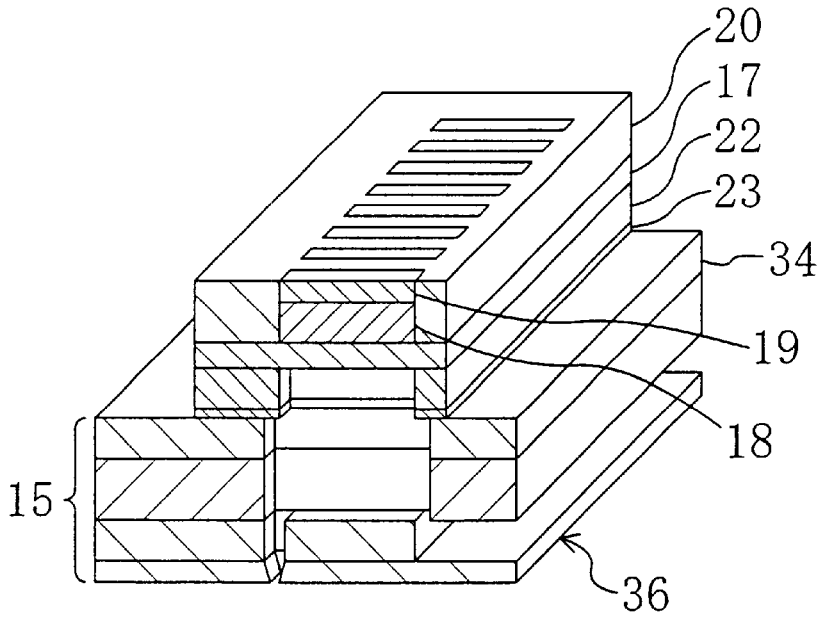

Thereafter, as shown in FIG. 8(*c*), the actuator portion 16 and the glass substrate 34 are inverted and the MgO substrate 30 is removed (see FIG. 9(*a*)). Then, as shown in FIG. 9(*b*), the glass substrate 34 is jointed to a main body block 36 in which the pressure-chamber recess portions 14, the common ink chamber 10, the nozzle orifices 12, and the like have been preformed. The main body block 36 and the glass substrate 34 together form the main body portion 15.

In the way described above, the ink jet head 1, in which the main body portion 15 and the actuator portion 16 are adhered together through the intermediate layer 22, is achieved.

As described above, in accordance with the ink jet head 1 of the present embodiment, because of the provision of the intermediate layer 22 between the oscillation plate 17 and the main body portion 15, even when the adhesive 23 is partly forced out, such a forced-out portion of the adhesive 23 will not adhere to the displacement portion 24 of the oscillation plate 17. Therefore, at the time when ink is jetted, the oscillation plate 17 is not prevented from performing its displacement operation in a smooth manner. Accordingly, even for the case of high-density heads, it is possible to satisfactorily maintain their jet performance.

In the present embodiment, the intermediate layer 22 is formed of copper, which facilitates the formation of the window portions 25. In addition, it becomes possible to form the intermediate layer 22 having a relatively great thickness in an easier manner. Furthermore, it is arranged such that the thickness of the intermediate layer 22 is set at 5 μm, so that, even when the adhesive area of the adhesive 23 is small and when the adhesion position is deviated, the variation in displacement of the oscillation plate 17 is held low. Accordingly, the ink jet performance is stabilized.

Embodiment 2

Figure 10:
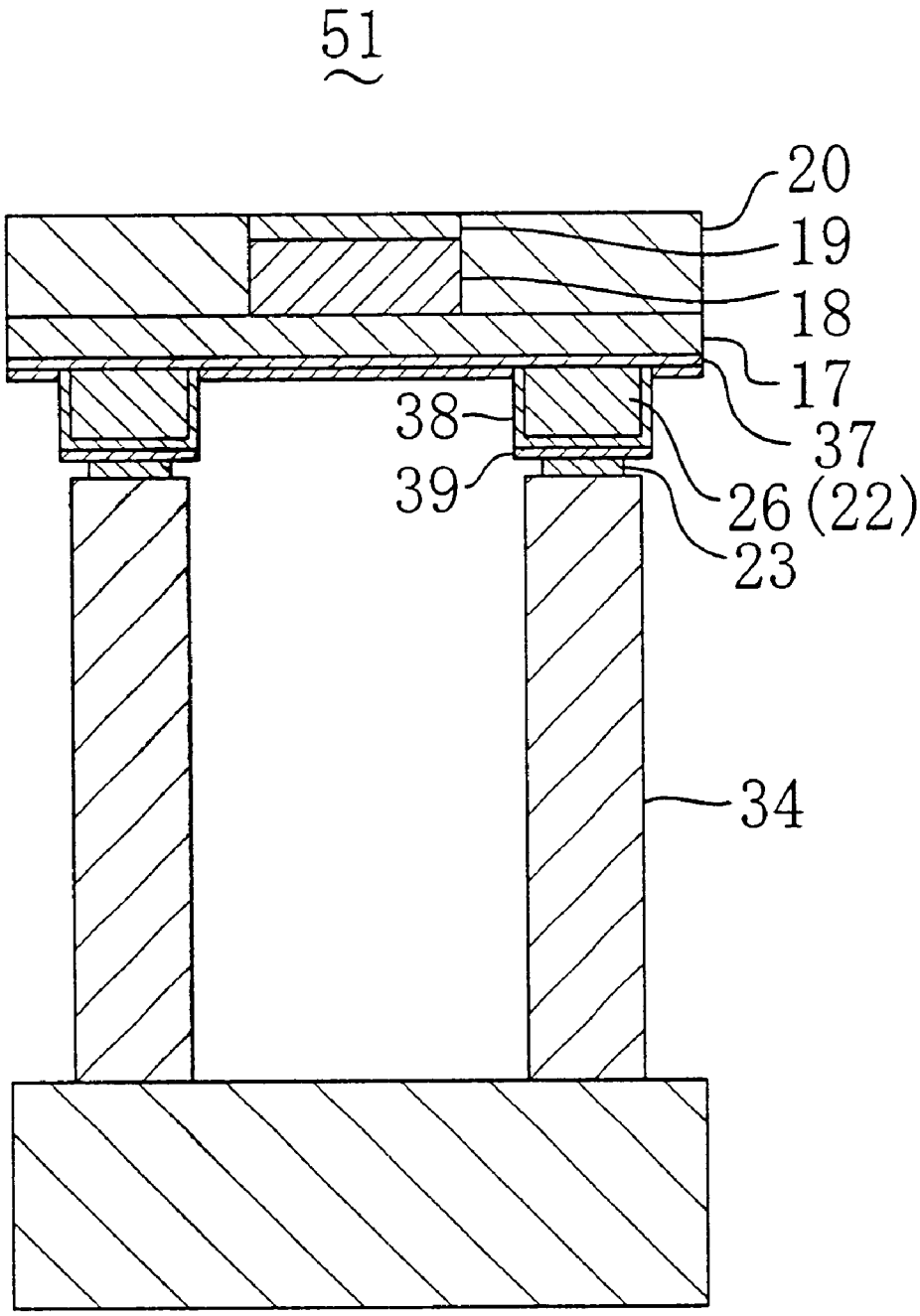
FIG. 10 is a partially sectional view of an ink jet head according to a second embodiment of the present invention.
Figure 11A:
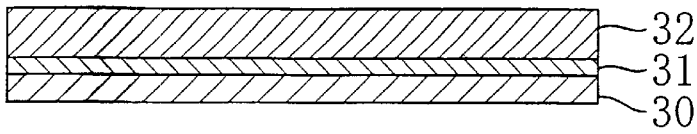
FIGS. 11(*a*)–11(*e*) are diagrams showing a part of steps of a fabrication method of the ink jet head according to the second embodiment.
Figure 11B:
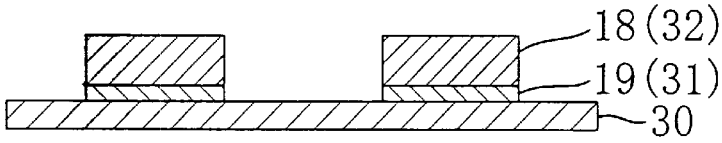
Figure 11C:
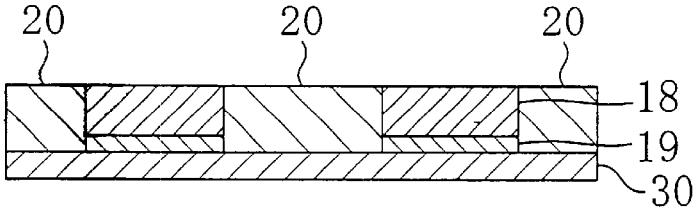
Figure 11D:
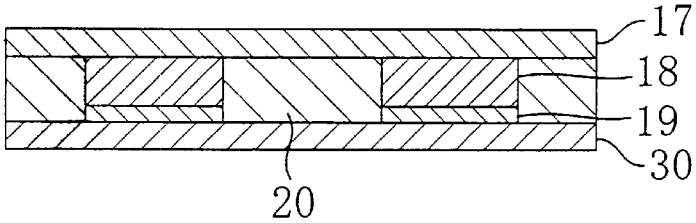
Figure 11E:
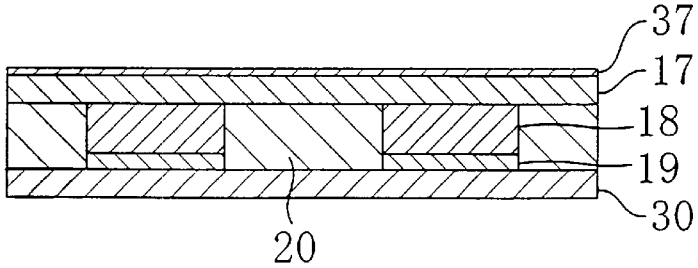
Figure 12A:
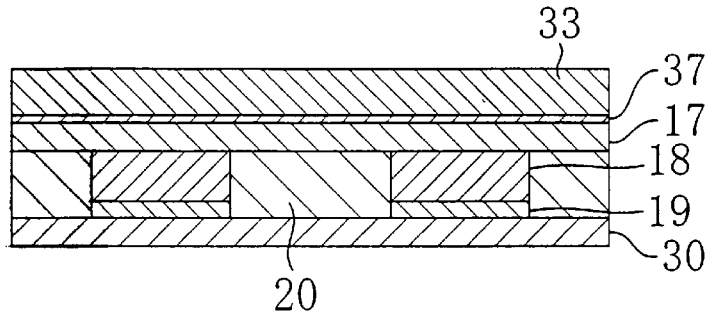
FIGS. 12(*a*)–12(*d*) are diagrams showing a part of the fabrication method steps of the ink jet head according to the second embodiment.
Figure 12B:
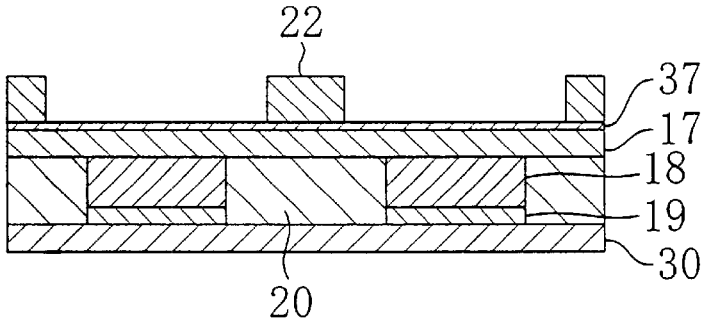
Figure 12C:
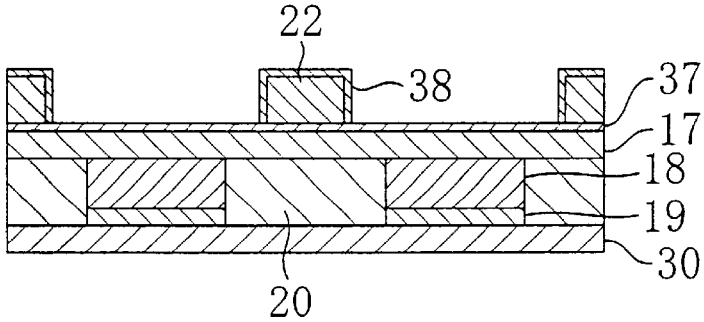
Figure 12D:
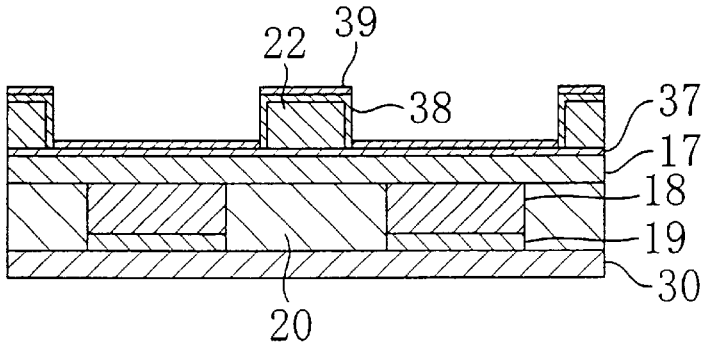

As shown in FIG. 10, an ink jet head 51 of a second embodiment of the present invention is characterized by the provision of an adhesion improving layer 37 between the oscillation plate 17 and the intermediate layer 22. The adhesion improving layer 37 is formed in order to improve the degree of adhesion between the oscillation plate 17 and the intermediate layer 22. The adhesion improving layer 37 is formed of a film of Ti (titanium) having a thickness of 0.05 μm (500 Å).

Formed on the partitioning portion 26 of the intermediate layer 22 is a first coat film 38 formed of a Ti film having a thickness of 0.2 μm. A second coat film 39 formed of a Cr film having a thickness of 0.05 μm is formed on a surface of the intermediate layer 22 that is brought into contact with the adhesive 23. In the present embodiment, both the adhesion improving layer 37 and the second coat film 39 are thin enough not to have a significant effect on the displacement operation of the oscillation plate 17. For this reason, the adhesion improving layer 37 and the second coat film 39 corresponding in position to the displacement portion 24 of the oscillation plate 17 are left as they are. However, in order to allow the oscillation plate 17 to perform its displacement operation in a smoother manner, these layers 37 and 39 located atop the displacement portion 24 can, of course, be removed.

In order not to cause obstruction to the operation of the oscillation plate 17, the adhesion improving layer 37 should be thin, the thinner the more preferable. However, if the adhesion improving layer 37 is formed too thin, this results in causing the layer 37 to have an island-like film shape, therefore making it difficult to form a satisfactory film. In order to prevent the layer 37 from having an island like film shape and to form the layer 37 as thin as possible, it is preferable for the adhesion improving layer 37 to have a thickness of from 0.01 μm up to 0.2 μm, more preferably, a thickness of from 0.01 μm up to 0.1 μm.

Next, a way of manufacturing the ink jet head 51 of the present embodiment will be described. In the first place, as in the first embodiment, the Pt film 31 having a thickness of 0.1 μm and the PZT thin film 32 having a thickness of 2.5 μm are formed, in that order, on the surface of the MgO substrate 30 (see FIG. 11(*a*)), which is followed by a patterning process so as to form the piezoelectric element 18 and the individual electrode 19 (see FIG. 11(*b*)). Thereafter, polyimide is embedded in removed portions of the Pt film 31 and the PZT thin film 32, thereby to form the insulating layer 20 (see FIG. 11(*c*)). Formed thereon is the oscillation plate 17 of a Cr film having a thickness of 2 μm (see FIG. 11(*d*)).

A Ti film having a thickness of 0.05 μm serving as the adhesion improving layer 37 is formed atop the oscillation plate 17 (see FIG. 11(*e*)). This is followed by formation of the Cu film 33 having a thickness of 5 μm on the surface of the adhesion improving layer 37 (see FIG. 12(*a*)). Thereafter, the Cu film 33 is subjected to patterning thereby to form the intermediate layer 22 (see FIG. 12(*b*)). Next, a Ti film having a thickness of 0.2 μm and serving as the first coat film 38 is formed on the surface of the intermediate layer 22 (see FIG. 12(*c*)). This is followed by formation of a Cr film having a thickness of 0.05 μm and serving as the second coat film 39, on the adhesion improving layer 37 and at a position on the first coat film 38 corresponding to the intermediate layer 22 (see FIG. 12(*d*)).

Following the above, like the first embodiment, the intermediate layer 22 of the actuator portion 16 and the glass substrate 34 of the main body portion 15 are adhered together through the adhesive 23 formed of an electrodeposition resin. That is to say, the glass substrate 34 is secured tightly to the main body block 36. As a result, the ink jet head 51 is formed.

As described above, in accordance with the ink jet head 51 of the present embodiment, the adhesion improving layer 37 is formed between the oscillation plate 17 and the intermediate layer 22, whereby the oscillation plate 17 and the intermediate layer 22 are closely adhered to each other. As a result, the intermediate layer 22 becomes less readily peelable, has a longer life span, and is superior in reliability. Since the adhesion improving layer 37 enhances the degree of adhesion, this allows both the oscillation plate 17 and the intermediate layer 22 to be formed of materials low in adhesion, thereby improving the degree of design freedom.

Moreover, by virtue of the provision of the first coat film 38 with which the partitioning portion 26 of the intermediate layer 22 is coated, the intermediate layer 22 formed of copper is not brought into direct contact with ink in the pressure chamber 11. This therefore prevents the intermediate layer 22 from readily being deteriorated by ink.

Furthermore, by virtue of the provision of the second coat film 39 formed of Cr between the intermediate layer 22 and the adhesive 23, the degree of adhesion between the intermediate layer 22 and the glass substrate 34 through the adhesive 23 is high. Accordingly, the actuator portion 16 and the main body portion 15 can be adhered tightly to each other.

Embodiment 3

A third embodiment of the present invention is similar to the first embodiment but is characterized by the arrangement that the intermediate layer 22 is formed of a film of Ti. Titanium is inferior in workability to copper but exhibits greater adhesion to chromium in comparison with copper. Because of such an arrangement of forming the intermediate layer 22 from a Ti film, the intermediate layer 22 can rigidly be formed with respect to the oscillation plate 17, without the provision of the adhesion improving layer 37 of the second embodiment. Accordingly, in accordance with the present embodiment, the process of forming the adhesion improving layer 37 becomes unnecessary, thereby shortening the manufacture process.

Other Embodiments

The intermediate layer 22 is not limited to copper or titanium. The intermediate layer 22 may be formed of other materials such as other metals, ceramics, and resin.

In each of the foregoing embodiments, the material of the main body portion 15 is not limited to glass. Metals such as SUS may be employed as a material used to form the main body portion 15.

The adhesive 23 is not limited to electron-deposition resin. Other types of resins such as epoxy resin may be used.

Figure 13:
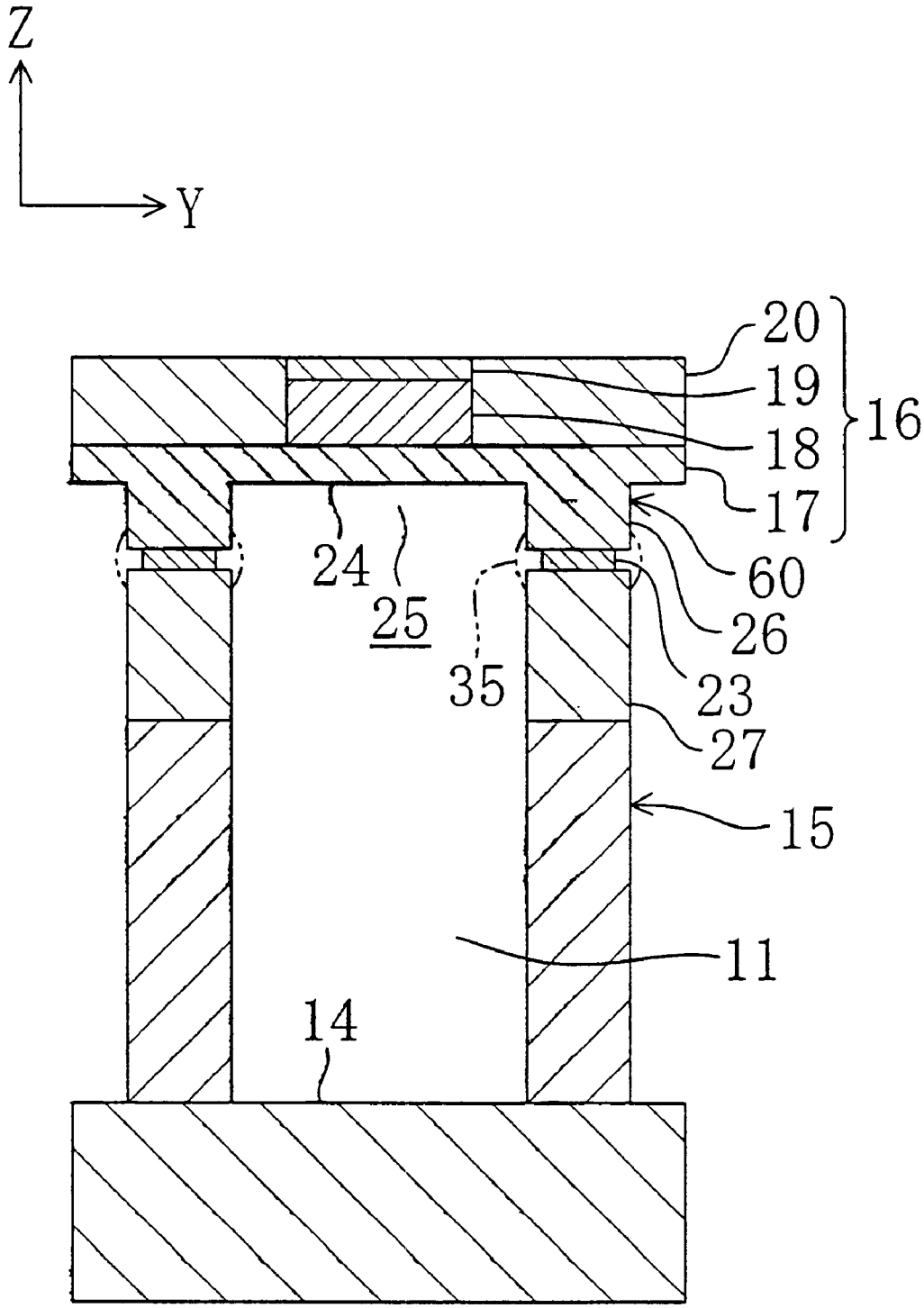
FIG. 13 is a partially sectional view of an ink jet head according to another embodiment of the present invention.
Figure 14:
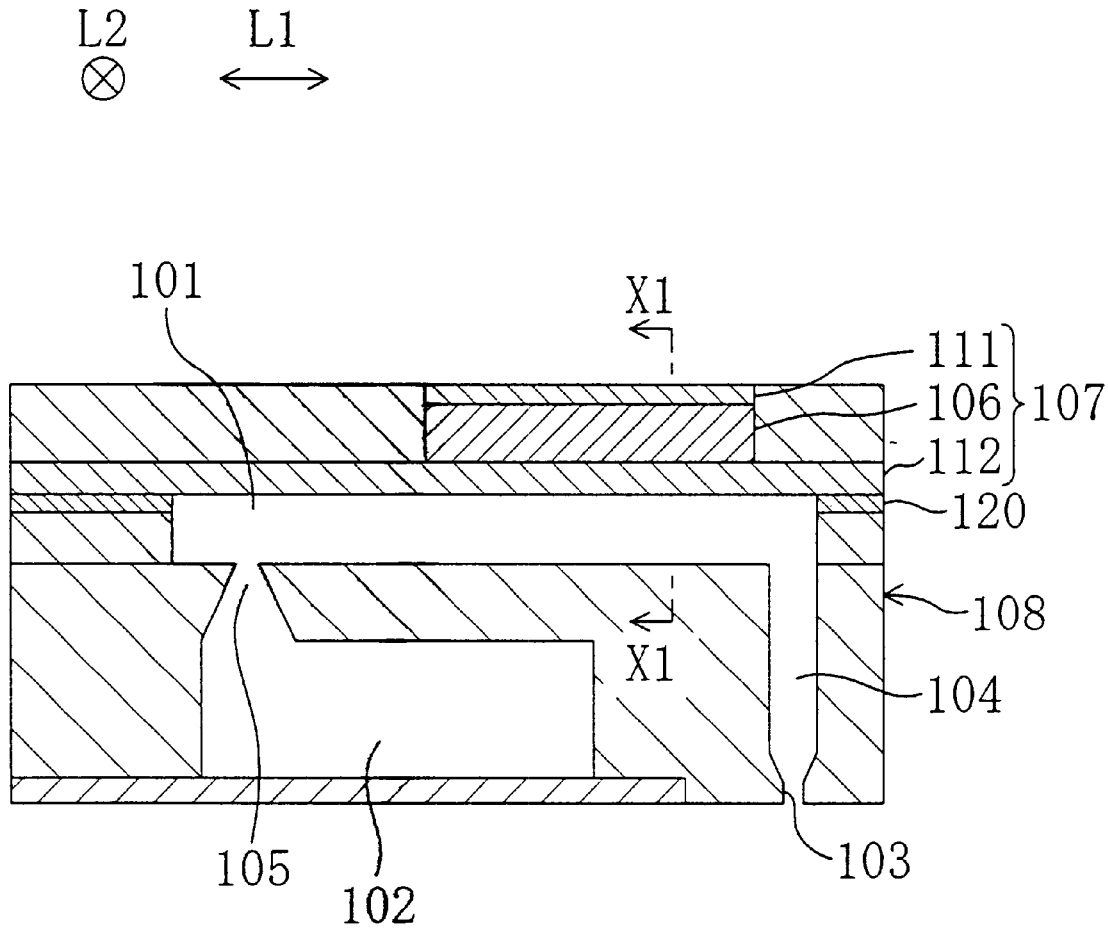
FIG. 14 is a partial sectional view of a prior art ink jet head.
Figure 15:
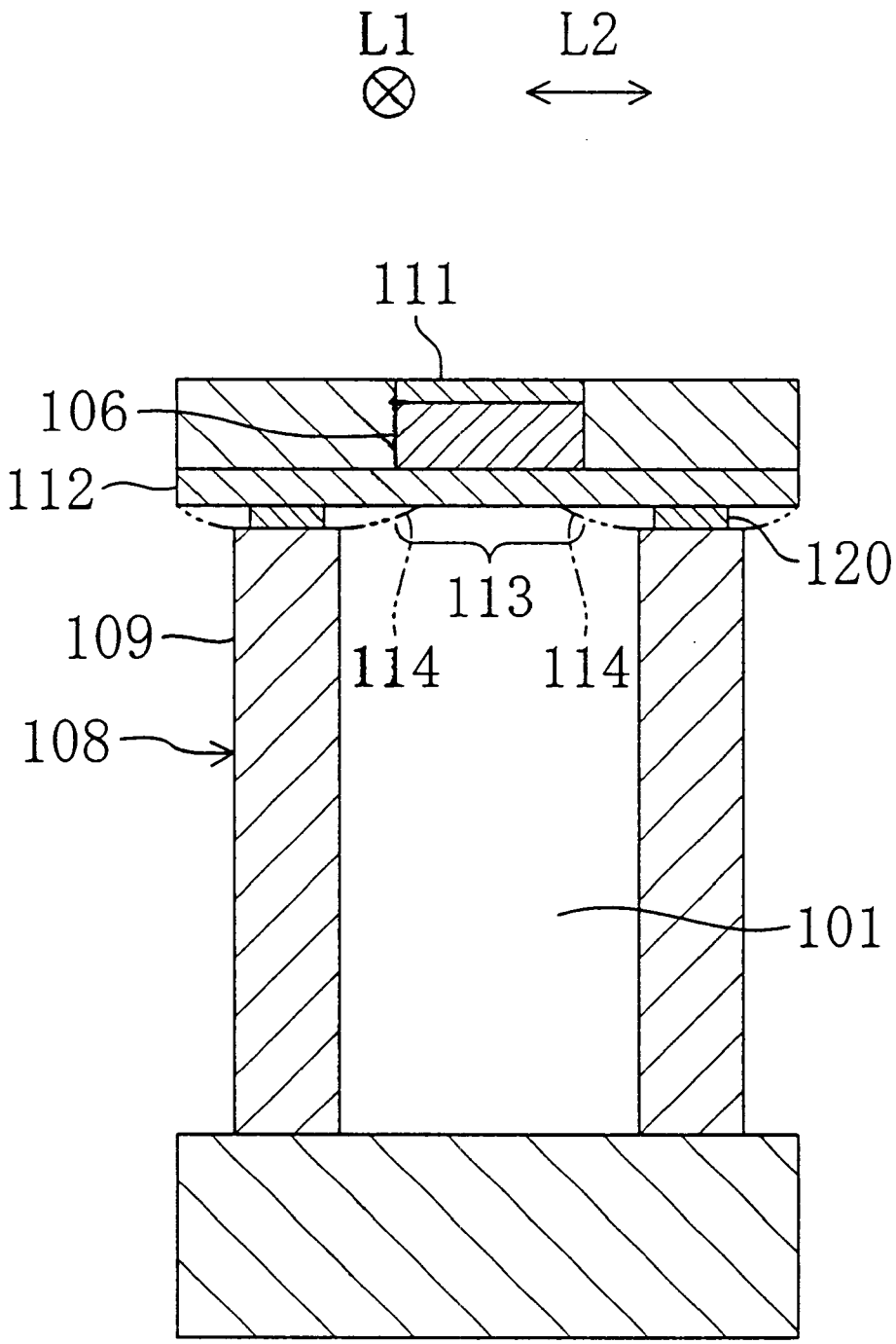
FIG. 15 is a cross sectional view taken on the line X1—X1 of FIG. 14.

In each of the foregoing embodiments, the intermediate layer 22 is formed separately from the oscillation plate 17. An arrangement may be made in which the intermediate layer 22 and the oscillation plate 17 are formed integrally. In other words, the intermediate layer 22 is formed of a part of the oscillation plate 17. For example, as shown in FIG. 13, a projection portion 60 for the attachment of the main body portion 15 to the oscillation plate 17 is formed on a surface of the oscillation plate 17 on the side of the main body portion 15, wherein the projection portion 60 functions as an intermediate layer. As a result of such arrangement, the foregoing effects can be provided by the projection portion 60 which is a part of the oscillation plate 17. Accordingly, there is no need to form the intermediate layer and the oscillation plate separately from each other.

It will be appreciated by those of ordinary skill in the art that the invention is not limited to any one of the foregoing embodiments and can be embodied in other specific forms without departing from the spirit or essential character thereof.

The presently disclosed embodiments are therefore considered in all respects to be illustrative and not restrictive. The scope of the invention is indicated by the appended claims rather than the foregoing description, and all changes which come within the meaning and range of equivalence thereof are intended to be embraced therein.

What is claimed is:

1. An ink jet head comprising (a) a head main body portion in which a pressure-chamber recess portion and a nozzle orifice are formed and (b) an actuator portion having (i) an oscillation plate which covers said pressure-chamber recess portion of said head main body portion so as to form, together with said head main body portion, a pressure chamber in the form of a compartment and (ii) a piezoelectric element which is rigidly fixed to said oscillation plate whereby the displacement of said oscillation plate generated by the piezoelectric effect of said piezoelectric element forces ink in said pressure chamber out of said nozzle orifice, wherein an intermediate layer is formed on a surface of said oscillation plate by the use of thin film formation technology and lies between said oscillation plate and said head main body portion for the prevention of adhesive adhesion to a displacement portion of said oscillation plate; and wherein said oscillation plate and said head main body portion are rigidly fixed together by an adhesive intervening between said intermediate layer and said head main body portion.

2. An ink jet head comprising (a) a head main body portion in which a pressure-chamber recess portion and a nozzle orifice are formed and (b) an actuator portion having (i) an oscillation plate which covers said pressure-chamber recess portion of said head main body portion so as to form, together with said head main body portion, a pressure chamber in the form of a compartment and (ii) a piezoelectric element which is rigidly fixed to said oscillation plate whereby the displacement of said oscillation plate generated by the piezoelectric effect of said piezoelectric element forces ink in said pressure chamber out of said nozzle orifice, wherein an intermediate layer having a window portion through which a displacement portion of said oscillation plate is exposed to said pressure chamber, and consisting of metal, ceramics, or resin is formed on a surface of said oscillation plate on the side of said head main body by the use of thin film formation technology; and wherein said oscillation plate and said head main body portion are rigidly fixed together by an adhesive intervening between said intermediate layer and said head main body portion.

3. The ink jet head according to either claim 1 or claim 2, wherein said intermediate layer is formed of copper.

4. The ink jet head according to either claim 1 or claim 2, wherein said intermediate layer is formed of titanium.

5. The ink-jet head according to either claim 1 or claim 2, wherein said intermediate layer is formed, having a thickness of 5 $\mu$m or greater.

6. The ink jet head according to claim 5, wherein said intermediate layer is formed, having a thickness of more than 7 $\mu$m.

7. The ink jet head according to claim 5, wherein said intermediate layer is formed, having a thickness of 30 $\mu$m or less.

8. The ink jet head according to either claim 1 or claim 2, wherein an adhesion improving layer is provided between said intermediate layer and said oscillation plate for the purpose of improving the degree of adhesion between said intermediate layer and said oscillation plate.

9. The ink jet head according to claim 8, wherein said oscillation plate is formed of chromium, said intermediate layer is formed of copper, and said adhesion improving layer is formed of titanium.

10. The ink jet head according to claim 8, wherein said adhesion improving layer is formed, having a thickness of 0.01 $\mu$m or greater.

11. An ink jet head comprising (a) a head main body portion in which pressure-chamber recess portion and nozzle orifice are formed and (b) an actuator portion having (i) an oscillation plate which covers said pressure-chamber recess portion of said head main body portion so as to form, together with said head main body portion, a pressure chamber in the form of a compartment and (ii) a piezoelectric element which is rigidly fixed to said oscillation plate whereby the displacement of said oscillation plate generated by the piezoelectric effect of said piezoelectric element forces ink in said pressure chamber out of said nozzle orifice, wherein a projection portion for mounting said oscillation plate on said head main body portion is formed on a surface of said oscillation plate opposite to said head main body portion by the use of thin film formation technology; and wherein said oscillation plate and said head main body portion are rigidly fixed together by an adhesive through said protection portion.

12. A method of manufacturing an ink jet head in which an oscillation plate is displaced by the piezoelectric effect of a piezoelectric element and the displacement of said oscillation plate forces ink in a pressure chamber out of a nozzle orifice, said method comprising the steps of:

forming on a surface of said oscillation plate an intermediate layer by use of thin film formation technology;

forming an opening in a position of said intermediate layer corresponding to a displacement portion of said oscillation plate; and with said opening of said intermediate layer brought into agreement in position with a pressure-chamber recess portion of said head main body portion, adhering together said intermediate layer and said head main body portion.

13. A method of manufacturing an ink jet head in which an oscillation plate is displaced by the piezoelectric effect of a piezoelectric element and the displacement of said oscillation plate forces ink in a pressure chamber out of a nozzle orifice, said method comprising the steps of:

forming on a surface of said oscillation plate an adhesion improving layer by use of thin film formation technology;

forming on a surface of said adhesion improving layer an intermediate layer;

forming an opening in at least a position of said intermediate layer corresponding to a displacement portion of said oscillation plate; and with said opening of said intermediate layer brought into agreement in position with a pressure-chamber recess portion of said head main body portion, adhering together said intermediate layer and said head main body portion.

* * * * *

UNITED STATES PATENT AND TRADEMARK OFFICE

CERTIFICATE OF CORRECTION

PATENT NO. : 6,547,376 B1
DATED : April 15, 2003
INVENTOR(S) : Watanabe et al.

It is certified that error appears in the above-identified patent and that said Letters Patent is hereby corrected as shown below:

Column 13,
Line 6, "protection" should be -- projection --

Signed and Sealed this

Sixteenth Day of December, 2003

JAMES E. ROGAN
*Director of the United States Patent and Trademark Office*